US005282670A

United States Patent [19]

Karsten et al.

[11] Patent Number: 5,282,670

[45] Date of Patent: Feb. 1, 1994

[54] CABLE ACTUATED VARIABLE STOP MECHANISM

[75] Inventors: Gary L. Karsten, Kentwood; Gregg R. Spoolstra, Byron Center; Kurt R. Heidmann; John C. Fuhs, both of Grand Rapids, all of Mich.

[73] Assignee: Steelcase Inc., Grand Rapids, Mich.

[21] Appl. No.: 870,950

[22] Filed: Apr. 20, 1992

[51] Int. Cl.[5] ..... A47C 1/025

[52] U.S. Cl. ..... 297/370; 297/300; 297/306

[58] Field of Search ..... 297/300, 301, 302, 306, 297/367, 368, 370, 371

[56] References Cited

U.S. PATENT DOCUMENTS

| | | | |
|---|---|---|---|
| T103,201 | 7/1883 | Robinson . | |
| 362,796 | 5/1887 | Tait . | |
| 1,043,112 | 11/1912 | Kronheim et al. | 297/370 X |
| 1,302,212 | 4/1919 | Phillips . | |
| 1,348,121 | 7/1920 | Kuderer . | |
| 1,699,894 | 1/1929 | Klemm . | |
| 2,145,307 | 1/1939 | Hunt . | |
| 2,310,476 | 2/1943 | Todd . | |
| 2,827,951 | 3/1958 | Herider et al. . | |
| 2,894,566 | 7/1959 | Herider et al. . | |
| 2,912,045 | 11/1959 | Milly . | |
| 3,046,055 | 7/1962 | Martens . | |
| 3,062,584 | 11/1962 | Galla . | |
| 3,111,343 | 11/1963 | Pearson . | |
| 3,127,788 | 4/1964 | Martens . | |
| 3,295,885 | 1/1967 | Barksdale . | |
| 3,309,129 | 3/1967 | Turner et al. | 297/367 |
| 3,339,975 | 9/1967 | Posh . | |
| 3,350,135 | 10/1967 | Martens . | |
| 3,356,411 | 12/1967 | Homier et al. . | |
| 3,369,841 | 2/1968 | Heyl, Jr. . | |
| 3,515,433 | 6/1970 | Tabor . | |
| 3,727,974 | 4/1973 | Swenson et al. . | |
| 3,801,155 | 4/1974 | Hodgen et al. . | |
| 3,877,088 | 4/1975 | Bouman . | |
| 3,897,608 | 8/1975 | Impicciche . | |
| 3,916,461 | 11/1975 | Kerstholt . | |
| 3,989,297 | 11/1976 | Kerstholt . | |
| 4,062,587 | 12/1977 | Wolters . | |
| 4,070,058 | 1/1978 | Muehling . | |
| 4,101,167 | 7/1978 | Ornberg . | |
| 4,198,094 | 4/1980 | Bjerknes et al. . | |
| 4,208,071 | 6/1980 | Pesiri . | |
| 4,354,710 | 10/1982 | Rauschenberger . | |
| 4,372,611 | 2/1983 | Feddeler . | |
| 4,384,743 | 5/1983 | Barley . | |
| 4,390,206 | 6/1983 | Faiks et al. . | |
| 4,478,454 | 10/1984 | Faiks . | |
| 4,494,795 | 1/1985 | Roossien et al. . | |
| 4,627,662 | 12/1986 | Carter et al. . | |
| 4,636,004 | 1/1987 | Neumuller . | |
| 4,640,547 | 2/1987 | Froome . | |
| 4,660,886 | 4/1987 | Terada et al. . | |
| 4,693,514 | 9/1987 | Volkle . | |
| 4,720,142 | 1/1988 | Holdredge et al. . | |
| 4,911,501 | 3/1990 | Decker et al. . | |
| 5,007,678 | 4/1991 | DeKraker . | |
| 5,046,780 | 9/1991 | Decker et al. . | |

FOREIGN PATENT DOCUMENTS

| | | | |
|---|---|---|---|
| 215604 | 5/1924 | United Kingdom | 297/370 |

*Primary Examiner*—Peter R. Brown
*Attorney, Agent, or Firm*—Price, Heneveld, Cooper, DeWitt & Litton

[57] ABSTRACT

An adjustable chair includes a base, a back and a chair control for pivotally connecting the back to the base for movement between a fully upright position and an inclined position. A cable actuated variable back stop mechanism includes a generally U-shaped bail or stop lever pivoted to the back. The bail is engageable with a stop on the chair base. A lock member is slideably mounted on the back. The lock member includes a front face defining a plurality of vertically spaced, generally parallel grooves. The grooves are dimensioned to receive the bail and hold the bail in one of a plurality of selected positions when the lock member is moved from an inoperative to an operative position. When in the operative position, the lock member prevents pivoting of the bail when it engages the stop on the base, hence, limiting tilting of the chair back.

30 Claims, 4 Drawing Sheets

CABLE ACTUATED VARIABLE STOP MECHANISM

BACKGROUND OF THE INVENTION

The present invention relates to office furniture and, more particularly, to adjustable chairs of the type including a base or pedestal, a back and a chair control for pivoting the back to the base.

A wide variety of adjustable office chairs are presently available which adapt to the particular user and task involved. Tilt back chairs include a chair control which permits the back to tilt or move from a fully upright to a fully inclined or reclined position. Provision may be made for preventing tilting of the chair back with respect to the base or seat. In addition, a variable stop mechanism may be included which provides a variety of maximum tilt positions. Adjustability of the degree of tilt of the back adapts the chair to the particular task and/or the user. Examples of chairs including variable stop or lock mechanisms may be found in commonly owned U.S. Pat. No. 4,720,142 entitled VARIABLE BACK STOP, which issued on Jun. 9, 1988 to Holdredge; commonly owned U.S. Pat. No. 4,494,795 entitled VARIABLE BACK ADJUSTER FOR CHAIRS, which issued on Jan. 22, 1985 to Roossien; and commonly owned U.S. Pat. No. 4,390,206 entitled SYNCHROTILT CHAIR CONTROL, which issued on Jun. 28, 1984 to Faiks et al.

The variable back stop mechanism disclosed in the aforementioned U.S. Pat. No. 4,720,142 includes a stop bracket connected to the chair support or base. A plurality of stop plates are provided in a stacked arrangement. The stop plates are carried by the chair back. Selected ones of the plates are moved forward when the chair back is moved to a desired stop or maximum tilt position. The degree of tilting or range of movement permitted is dependent upon the number of the stacked plates which have been moved forward. Thereafter, upon tilting movement from a fully upright towards a reclined position, the plates will contact the stop bracket on the chair support. Further tilting action is, therefore, prevented.

A need exists for an improved adjustable chair and variable back stop mechanism of reduced complexity than that heretofore available, which may be easily assembled or incorporated in a chair without changing or significantly modifying the parts of the chair, which is reliable in use and which may be manufactured and installed at reduced costs from that heretofore experienced.

SUMMARY OF THE INVENTION

In accordance with the present invention, the aforementioned needs are substantially fulfilled. Essentially, an adjustable chair includes a back pivoted to a base or support pedestal through a chair control. The back is moveable from a fully upright position to a fully reclined position. A variable back stop mechanism is provided. The back stop mechanism includes a stop lever adapted to be moveably mounted or pivoted to the back structure of the chair. A lock member is moveable between an operative and an inoperative position. When in the operative position, the lock member engages the stop lever and holds or locks the lever in one of a plurality of angular positions. The lock lever moves with the chair back and engages a stop defined by or included on the chair base. When locked in position, tilting of the back is prevented when the lever contacts the stop.

In narrower aspects of the invention, the lock member includes a curved face defining a plurality of vertically spaced, generally parallel grooves. The lock lever is generally U-shaped and includes a base and side legs. The legs are pivoted to the chair back. When in the operative position, the lock member grooves receive the base of the lock lever holding it in position.

In further aspects of the invention, a cable actuator including a cable assembly and a moveable button is operatively connected to the lock member. Shifting of the button moves the lock member between its operative and inoperative positions.

In accordance with the present invention, the degree of backward tilting of the chair back may be varied, permitting the chair to be adjusted to the particular task being performed or the physical characteristics of the user. The variable back stop mechanism is easily actuated from a seated position through the cable actuator. The chair control and variable back stop mechanism are relatively economical to manufacture, efficient in use and capable of a long and reliable life.

DETAILED DESCRIPTION OF THE PREFERRED EMBODIMENTS

Figure 1:
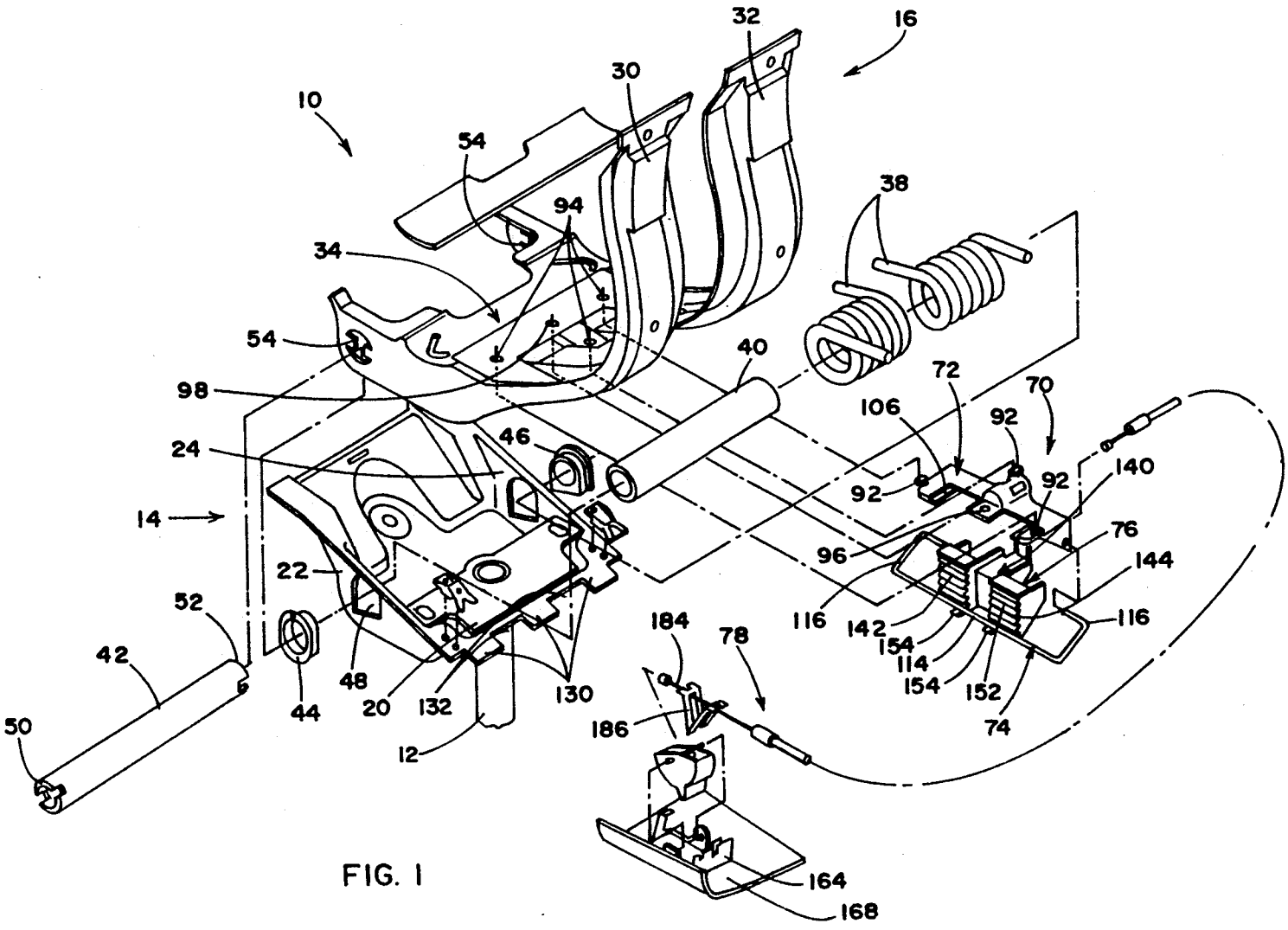
FIG. 1 is an exploded view of a chair subassembly in accordance with the present invention.

An adjustable chair subassembly in accordance with the present invention is illustrated in FIG. 1 and generally designated by the numeral 10. Chair 10 includes a base, support or pedestal 12, a control and housing subassembly 14 and a back subassembly 16. In a conventional fashion, base or support pedestal 12 may include a plurality of arms and castors (not shown). A seat cushion and a back cushion (not shown) are mounted on the control and housing subassembly 14 and the back support subassembly 16 in a conventional fashion.

Housing subassembly 14 includes a base plate 20 and side walls 22, 24. Pedestal or base 12 is joined to base plate 20 to fix housing subassembly 14 relative to ground. Back subassembly 16 includes a pair of configured, upright members 30, 32. Members 30, 32 are adapted to support the back cushion or shell of the chair. Uprights 30, 32 are joined to a forward portion 34. A torsional energy storage device or spring subassembly mounts forward portion 34 and, hence, uprights 30, 32 to housing 14. The spring subassembly includes torsion springs 38, a bushing 40, an axle 42 and end support bearings 44, 46. Bearings 44, 46 are disposed in apertures 48 formed in side walls 22, 24. Axle 42 includes ends 50, 52 received in configured apertures 54 formed in sides of forward portion 34 of the upright subassembly 16. The torsional energy storage device or spring subassembly is conventional in nature. The housing and chair control including the spring subassembly may be as generally disclosed in the aforementioned commonly owned U.S. Pat. No. 4,720,142. Uprights 30, 32 and the back subassembly 16 are pivotal about axis 42 relative to the base or support pedestal 12 from a fully upright position to a fully reclined position. Torsional springs 38 resiliently bias the upright subassembly 16 to the fully upright position.

A variable back stop subassembly, as illustrated in FIGS. 1, 2, 3 and 4, is included to limit or control the degree of tilt permitted. As shown, the variable back stop subassembly 70 includes a carrier, support or bracket 72, a stop lever 74, a cam or lock member 76 and an actuator or cable subassembly 78.

As shown, carrier 72 includes a central cable housing attachment portion 82, arms 84, 86 extending outwardly therefrom, and sides 88. A plurality of generally L-shaped lugs or tabs 92 extend upwardly from portions 82, 84 and 86. In the presently preferred form, upright subassembly 16 is formed with or defines a plurality of apertures 94. Apertures 94 are dimensioned and positioned to receive mounting lugs or tabs 92 in a snap-fit fashion. In addition, a locator boss 96 is defined on central portion 82 of carrier 72. Locator boss 96 is positioned within a circular aperture 98 defined by upright subassembly 16. Carrier 72 further defines a pair of slots 102, 104. Each slot defines spaced, parallel flange-like guide surfaces 106. Portion 82 defines lateral slots 108. As described below, the slots and surfaces define a guide structure to slideably receive lock member 76.

Side walls 88 of carrier 72 define coaxially aligned pivot apertures 112. Stop lever 74, in the preferred form, is a generally U-shaped bail including a base 114 joined to generally parallel legs 116. Legs 116 terminate in in-turned ends 120. Ends 120 are snapped into pivot apertures 112. Stop lever 74, therefore, pivots with respect to the carrier 72 and, hence, with respect to upright subassembly 16. A spring 122 has an end engaging carrier 72 and another end 124 which engages a leg 116 of a lever. Spring 122, therefore, biases lever 74 downwardly or in a counterclockwise direction when viewed in FIGS. 2 and 3.

Figures 4, 5:
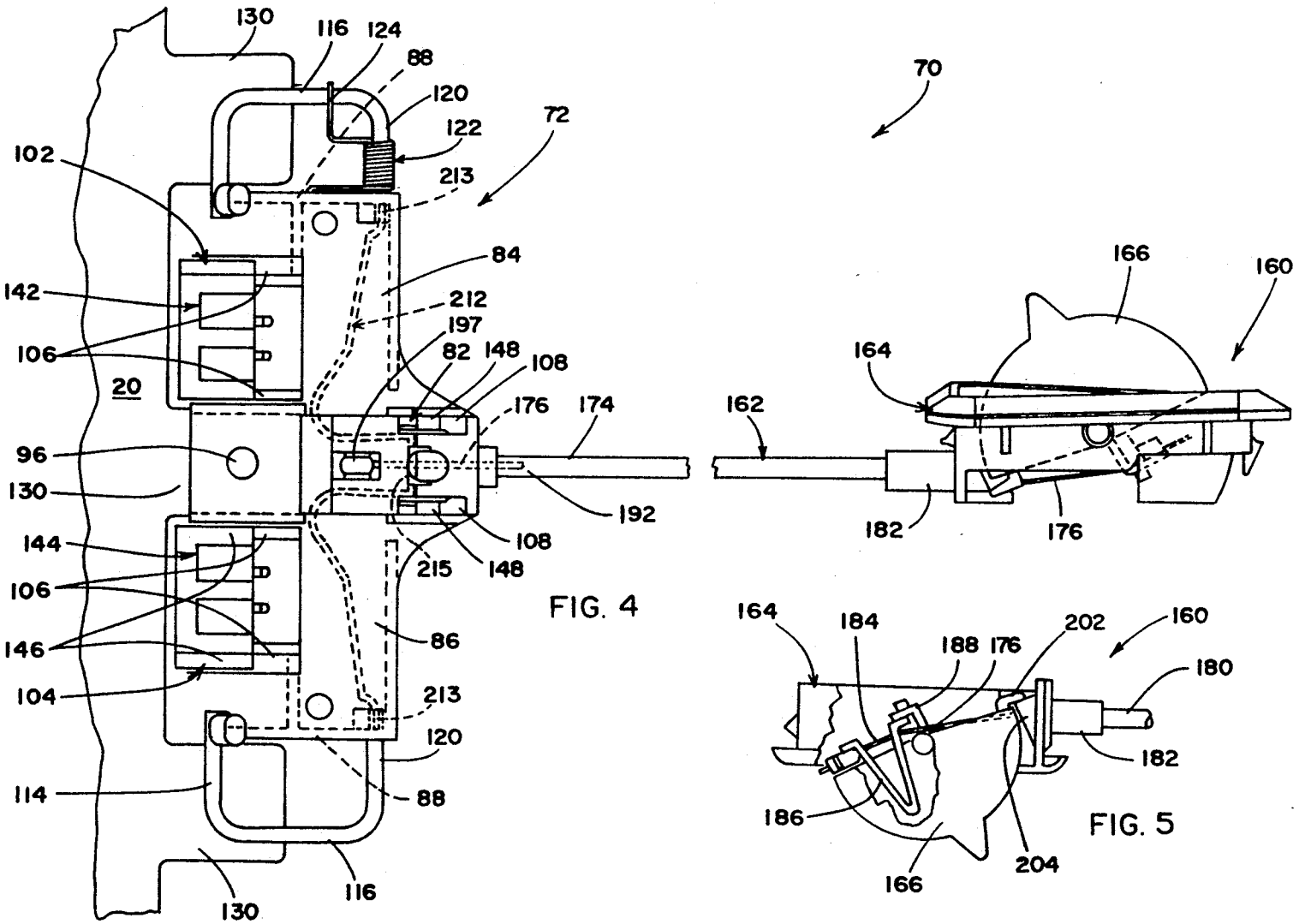
FIG. 4 is a fragmentary, top, plan view of a portion of the chair control and the variable back stop mechanism.
FIG. 5 is a fragmentary, side elevational view of a portion of the cable actuator and button subassembly incorporated in the back stop mechanism.

As seen in FIGS. 1 and 4, plate 20 of housing subassembly 14 defines a plurality of rearwardly directed stops or tabs 130. Stops 130 are separated by slots 132. Base 114 of stop lever 74 is positioned by carrier 72 so that it will engage the stops 130 as upright subassembly 16 tilts backwardly or pivots about axis 42 from its fully upright position towards its fully reclined position.

Figure 2:
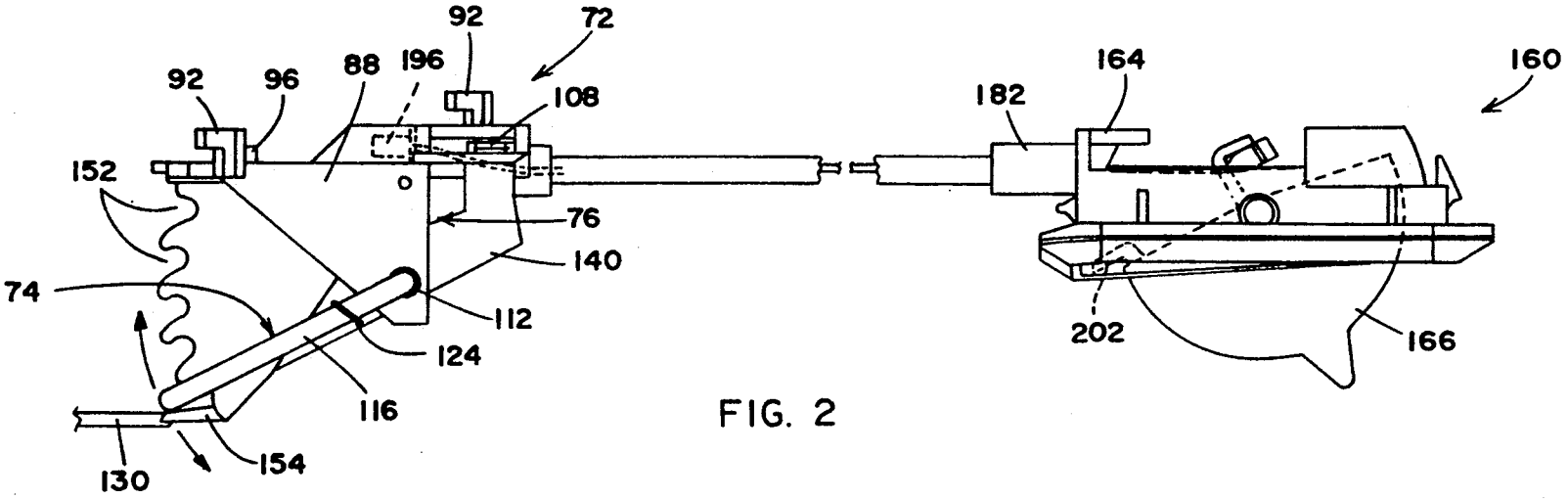
FIG. 2 is a side elevational view of a cable actuated variable back stop mechanism incorporated in the chair subassembly of FIG. 1 showing a lock member in the inoperative position.

Provision is made for locking the position of lock lever 74 with respect to the back to limit the maximum tilt position or provide a variable back stop for the chair. In the preferred form, a lock member 76 is provided having a block-like configuration. Member 76 includes a central portion 140 and spaced wings 142, 144. Wing portions 142, 144 each include upper slide flanges 146. Portion 140 includes slide lugs 148. Slide flanges 146 ride on guide surfaces 106 defined by a carrier 72. Lugs 148 ride in slots 108. Lock member 76 is slideable from a rearward, inoperative position illustrated in FIG. 2 to a forward, operative position illustrated in FIG. 3. Each wing 142, 144 includes a curved front face which defines a plurality of vertically spaced, parallel grooves 152. In addition, lock member 76 includes forwardly extending lower limit tabs 154. As shown in FIG. 2, tabs 154 are engaged by the base of lock lever 74 when lock member 76 is in its inoperative position and upright subassembly 16 is in a fully upright position.

As shown, cable actuator 70 includes a button subassembly 160 and a cable subassembly 162. Button subassembly 160 includes a button housing 164 which rotatably mounts an actuator button 166. As illustrated in FIG. 1, housing 164 is positioned in a suitable aperture formed in a portion 168 of the chair seat shell or cushion assembly. Cable assembly 162 includes a tubular housing 174 and a cable 176. Relative movement between the housing 174 and cable 176 is achieved by rotation of button 166. An end 180 of cable housing 174 is received within a boss 182 attached to actuator housing 164. As shown in FIG. 5, a free end 184 of cable 176 may be attached to a generally V-shaped leaf spring 186. Leaf spring 186 rests against and is trapped by a retaining portion 188 defined by button 166. Leaf spring 186 provides an over-travel feature for the actuator.

An opposite end 192 of housing 174 is received within a boss 196 which is attached to central portion 140 of lock member 76. An end 197 of cable 176 extends through boss 196 and is fixed to carrier 72. As should be apparent, rotation of button 166 causes lock member 76 to shift relative to carrier 72. This moves the lock member from the inoperative position shown in FIG. 2 to the operative position shown in FIG. 3.

As shown best in FIG. 5, button 166 is maintained in an operative position in a positive fashion. Button 166 includes a generally L-shaped, resilient detent 202. Housing 164 includes a lock or detent flange 204. As button 166 is rotated to the locked position, detent 202 cams over detent flange 204 until the flange is positioned below the detent. The button is now held in a locked position in a positive fashion. Sufficient force must be applied to the button to cam detent 202 off of detent flange 204. As shown in FIG. 4, a wire spring 212 is supported on or mounted on carrier 72. Springs 212 have ends 213 connected to carrier 72 and a portion 215 connected to or engaging lock member 70. Spring 212 engages lock member 76 and pulls or biases the lock member towards its inoperative position. When button 166 is rotated to shift detent 202 off of flange 204 and, hence, release the button, spring 212 shifts lock member 76 to the unlocked position shown in FIG. 2.

In use, the variable back stop mechanism 70 is assembled to upright subassembly 16 by snapping lugs or tabs 92 into their respective apertures 94 defined by the upright subassembly. When the actuator button is positioned so that lock member 76 is in the inoperative position as shown in FIG. 2, upright subassembly 16 may be pivoted about its axis 42. Lock member 76 is retracted rearwardly and moves in an arc with upright subassembly 16 by passing through slots 132. Base 114 of stop lever 74 engages stops 130. The lever will, however, pivot about its ends at pivot apertures 112 of carrier 72 as the back tilts downwardly. Unrestricted movement of the back from its fully upright to its fully reclined position, as determined by the chair control housing 14 and the configuration of the upright subassembly 16, is permitted.

Figure 3:
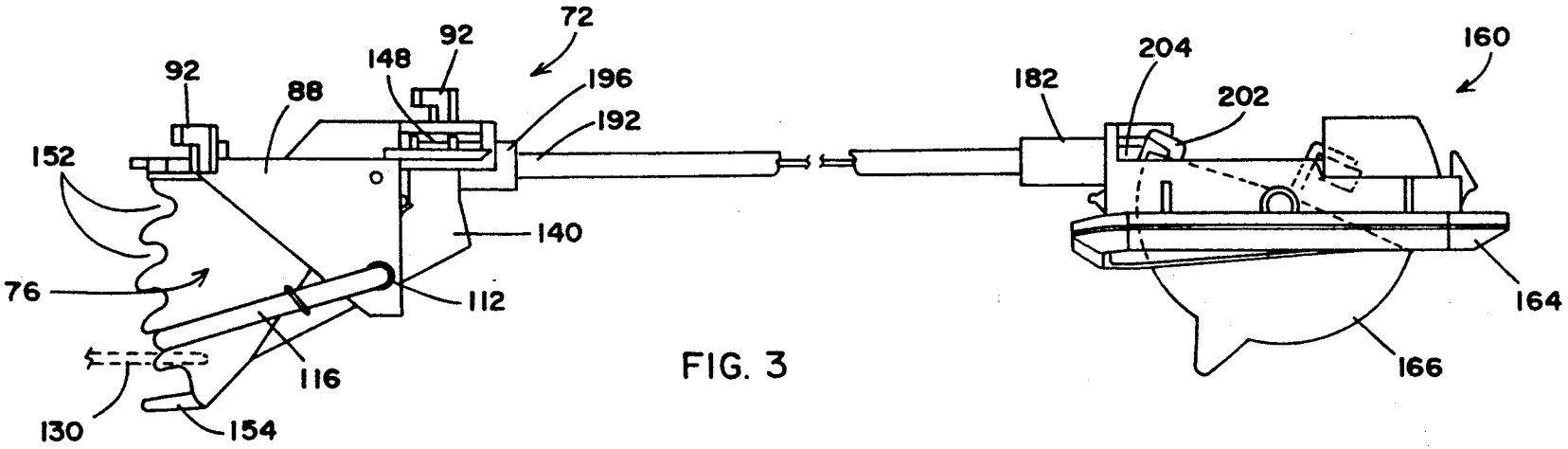
FIG. 3 is a side elevational view of the variable back stop mechanism of FIG. 2 showing the lock member in the operative position.

Should it be desired to change the maximum degree tilt permitted by the back subassembly 16, the user will tilt the chair to the desired tilt position, as schematically shown, for example, in FIG. 3. Button actuator 166 is rotated from the inoperative position shown in FIG. 2 to the operative or locked position shown in FIG. 3.

This causes lock member 76 to shift forwardly so that base 114 of stop lever 74 is received in selected ones of the grooves 152. As a result, lock lever 74 is prevented from pivoting or tilting with respect to the back. When the chair upright is now moved from the fully upright position towards a reclined position, base 114 will contact stops 130 since the bail is fixed now with respect to the back subassembly 16, further tilting movement is prevented.

The variable back stop mechanism permits selective setting of the degree of rearward travel or tilting movement for the back. The mechanism is significantly less complex than prior variable stop mechanisms. The assembly is easily added to a chair. The basic chair need only be provided with the apertures 94 in the upright subassembly 16 and with the stop tabs 130 on the chair control housing. Should the variable back stop feature be desired in the chair, the assembled mechanism 70 is easily snapped in position on the upright. The cable actuator 160 provides increased versatility to the chair designer in the location of the actuator button or control.

Figure 6:
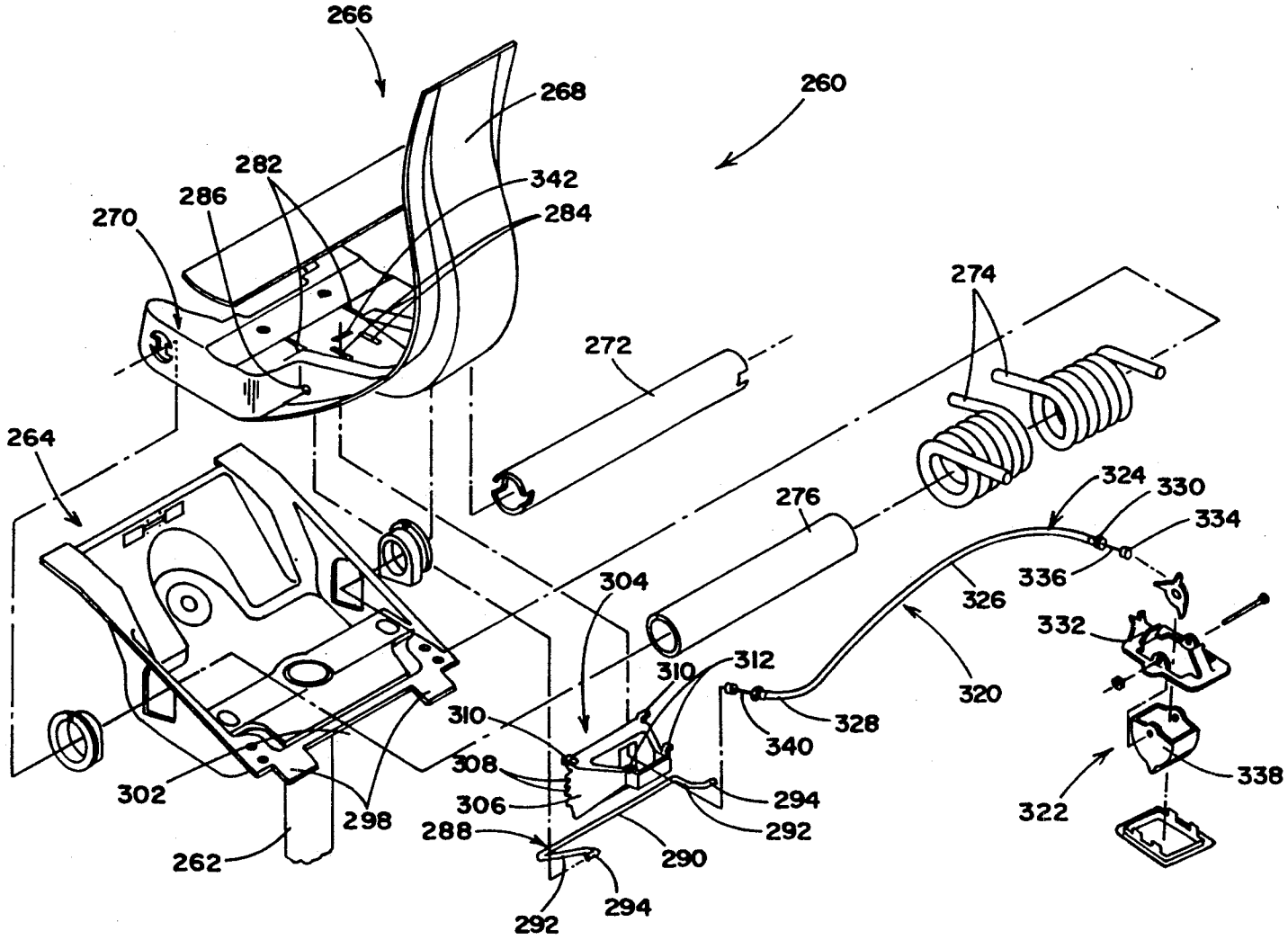
FIG. 6 is an exploded view of an alternative embodiment of the present invention.

An alternative embodiment of a chair subassembly in accordance with the present invention is illustrated in FIG. 6 and generally designated by the numeral 260. Chair 260 includes a spindle, pedestal or base 262, a chair control housing 264 secured to an upper end of base 262 and a tiltable upright or back subassembly 266. Upright subassembly 266 includes a configured upright back portion 268 to which the seat back may be attached. Portion 268 is joined to a forward portion 270. Portion 270 is pivoted to housing 264 by an axle 272. A pair of torsion springs 274 are positioned over a bushing 276 which, in turn, is positioned over axle 272. In a conventional fashion, torsion springs 274 resiliently bias upright subassembly 266 to a fully upright position. In the embodiment of FIG. 6, forward portion 270 of upright 266 defines elongated slots 282, 284. In addition, portion 270 defines coaxially aligned, spaced pivot apertures 286.

A bail shaped stop lever 288 includes a base 290 and legs 292. Legs 292 include outwardly turned ends 294. Ends 294 mount the bail on the back and snap into pivot apertures 286 defined by assembly 266. Control housing 264 defines a pair of spaced stop tabs 298 which extend rearwardly therefrom. Tabs 298 are separated by a slot 302. The tabs 298 are positioned so that they will be contacted by base 290 of stop lever 288 as upright 268 pivots rearwardly towards its fully reclined position.

A lock member 304 includes a forward surface or face 306 which defines a plurality of vertically spaced, elongated grooves 308. Grooves 308 are dimensioned to receive base 290 of bail 288 when member 304 is shifted to a forward, operative position. Member 304 defines L-shaped mounting tabs or lugs 310, 312. Tabs 310 snap into and ride within slots 282. Tabs 312 snap into and ride within slots 284. As a result, lock member 304 is slideably mounted directly on upright subassembly 266, and the carrier of the FIG. 1 embodiment is eliminated.

Lock member 304 is shifted between its inoperative, rearward position and its operative, forward position by a cable actuator subassembly 320. Subassembly 320 includes a button actuator subassembly 322 and a cable subassembly 324, as in FIG. 1. A housing 326 of cable assembly 324 has an end 328 of engaging lock member 304. An opposite end 330 of housing 326 engages a button housing 332. An end 334 of a cable 336 is connected to the pivotal button 338. An opposite end 340 of cable 336 is secured to upright subassembly 266 at a slot 342.

The embodiment of FIG. 6 operates in substantially the same manner as the embodiment of FIGS. 1-5. When lock member 304 is in its rearward or inoperative position, upright subassembly 266 may be tilted rearwardly throughout its full range of motion about axle 272. As the back tilts, base 290 of stop lever or bail 288 engages stop tabs 298. The bail pivots at pivot apertures 286 to permit the back to recline. When lock member 304 is shifted to its forward or operative position at a desired maximum tilt position, the lock lever is fixed in position relative to upright subassembly 266. Pivotal action is no longer permitted. As the upright, therefore, tilts rearwardly, base 290 will contact stop 298 preventing further rearward tilting movement.

The chair and the back stop mechanism in accordance with the present invention permit ready addition of a variable back stop feature with little or minimal modification to the existing back, base and chair control components. The cable actuator provides versatility to the chair designer in the location of the actuator button. The assembly is of a reduced mechanical complexity from variable back stop mechanisms heretofore provided. Increased ease of assembly and reduced costs result from the present invention.

In view of the foregoing description, those of ordinary skill in the art may envision various modifications to the present invention which would not depart from the inventive concepts disclosed. For example, the button actuator could include a sliding button as opposed to the pivoting button illustrated. The precise configuration of the lock member could be modified while retaining a grooved face feature to capture or engage the lock or stop lever. It is intended, therefore, that the above description should be considered as only that of the preferred embodiments. The true spirit and scope of the present invention may be determined by reference to the appended claims.

The embodiments of the invention in which an exclusive property or privilege is claimed are defined as follows:

1. A variable back stop mechanism for a chair of the type having a support which includes a stop and a back pivoted to the support for tilting movement between an upright position and a reclined position, said mechanism comprising:

a stop lever adapted to be moveably mounted on the back;

lever mounting means for moveably mounting said lever on the back, said stop lever and lever mounting means positioned and configured so that said lever will engage the stop on the support as the back tilts;

a lock;

lock mounting means for moveably mounting said lock on the back for movement between an inoperative position at which the stop lever can freely move and an operative position engaging the stop lever and selectively holding it in one of a plurality of positions at which it engages the support stop and limits tilting movement of the back; and actuator means operatively connected to said lock for moving said lock between said operative and inoperative positions.

2. A variable back stop as defined by claim 1 wherein said stop lever is generally U-shaped and includes a base and spaced legs.

3. A variable back stop as defined by claim 2 wherein said lock includes a front face which defines a plurality of generally parallel, vertically spaced grooves, said grooves dimensioned to receive said base of said stop lever when said lock is in the operative position.

4. A variable back stop as defined by claim 3 wherein said legs of said stop lever are in-turned to define said lever mounting means.

5. A variable back stop as defined by claim 4 wherein said lock mounting means comprises a bracket adapted to attach to the chair back, said bracket defining a guide, said lock being slideably received by said guide.

6. A variable back stop as defined by claim 5 wherein said bracket defines a pair of pivot apertures, said in-turned ends of said lever legs being pivoted in said apertures.

7. A variable back stop as defined by claim 6 further comprising:

a spring engaging said bracket and said lock for biasing said lock towards the operative position.

8. A variable back stop as defined by claim 7 further comprising:

another spring engaging said stop lever for biasing said lever to a lowermost position.

9. A variable back stop as defined by claim 8 wherein said lock further includes a motion limiting tab engageable by said stop lever when the lever is in its lowermost position.

10. A variable back stop as defined by claim 9 wherein said actuator means comprises:

a button housing adapted to be mounted on the chair;

a cable assembly including a housing and a cable; and a button moveably mounted in said button housing, said cable housing having an end engaging the button housing and an end engaging said lock and wherein said cable has an end connected to the button and another end fixed with respect to said chair back.

11. A variable back stop as defined by claim 1 wherein said lock mounting means comprises a plurality of upstanding generally L-shaped tabs joined to said lock.

12. A variable back stop as defined by claim 11 wherein said stop lever includes a base joined to generally parallel legs, said legs each including a configured end adapted to pivotally mount said lever to the chair back.

13. A variable back stop as defined by claim 12 wherein said lock includes a front face which defines a plurality of generally parallel, vertically spaced grooves, said grooves dimensioned to receive said base of said stop lever when said lock is in the operative position.

14. A variable back stop as defined by claim 1 wherein said actuator means comprises:

a button housing adapted to be mounted on the chair;

a cable assembly including a housing and a cable; and a button moveably mounted in said button housing, said cable housing having an end engaging the button housing and an end engaging said lock and wherein said cable has an end connected to the button and another and fixed with respect to said chair back.

15. A variable back stop as defined by claim 14 wherein said actuator further includes an over-travel spring connecting said cable end to said button.

16. An adjustable chair subassembly, comprising:

a chair base;

a back;

control means pivotally connecting the back to the chair base for allowing the back to tilt from a fully upright position to a fully inclined position; and variable back stop means on said back and chair base for stopping tilting of said back in a selected position between said fully upright and inclined positions, said variable back stop mechanism comprising:

a stop lever pivoted to said back, said control means defining at least one stop engageable by said stop lever as said back tilts between said fully upright and inclined positions; and lock means moveably mounted on said back and having an inoperative position and an operative position for selectively engaging and locking said stop lever in any of a plurality of positions, said stop lever engaging said stop and moving as said back tilts when the lock means is in its inoperative position and said stop lever engaging said stop and preventing further tilting of said back when said lock means is in its operative position.

17. An adjustable chair subassembly as defined by claim 16 further including:

actuator means operatively connected to said lock means for shifting said lock means between said operative and inoperative positions.

18. An adjustable chair subassembly as defined by claim 17 wherein said stop lever comprises a generally U-shaped bail including a base portion and legs, said legs being pivoted relative to said chair base.

19. An adjustable chair subassembly as defined by claim 18 wherein said lock means comprises:

a lock member including a front face which defines a plurality of grooves, each of said grooves being dimensioned to receive said base portion of said bail when said lock means is in said operative position.

20. An adjustable chair subassembly as defined by claim 19 wherein said lock means further comprises:

a carrier fixedly attached to said back, said lock means being slideably mounted on said carrier.

21. An adjustable chair subassembly as defined by claim 20 wherein said lock means further comprises:

a carrier spring engaging said lock member for biasing the lock member towards its operative position.

22. An adjustable chair subassembly as defined by claim 21 wherein said legs of said stop lever are pivoted to said carrier.

23. An adjustable chair subassembly as defined by claim 22 wherein said lock member defines a lower limit tab engageable by said bail when said lock member is in its inoperative position and the back is in its fully upright position.

24. An adjustable chair subassembly as defined by claim 23 wherein said actuator means comprises:

a button housing adapted to be mounted on the chair;

a cable assembly including a housing and a cable; and a button moveably mounted in said button housing, said cable housing having an end engaging the button housing and an end engaging said lock member and wherein said cable has an end connected to the button and another end fixed to said chair back.

25. An adjustable chair subassembly as defined by claim 24 wherein said lock means further comprises:

a bail spring engaging said bail for biasing said bail towards said lower limit tab.

26. An adjustable chair subassembly as defined by claim 25 wherein said actuator further includes an overtravel spring connecting said an end of said cable to said button.

27. An adjustable chair subassembly as defined by claim 19 wherein said back defines a pair of pivot apertures and said legs of said bail are disposed within said apertures.

28. An adjustable chair subassembly as defined by claim 27 wherein said back defines an elongated slot and said lock member includes a slide tab disposed within said slot.

29. An adjustable chair subassembly as defined by claim 28 wherein said actuator means comprises:

a button housing adapted to be mounted on the chair;

a cable assembly including a housing and a cable; and a button moveably mounted in said button housing, said cable housing having an end engaging the button housing and an end engaging said lock member and wherein said cable has an end connected to the button and another end fixed to said chair back.

30. An adjustable chair subassembly as defined by claim 29 wherein said actuator further includes an overtravel spring connecting said an end of said cable to said button.

* * * * *

UNITED STATES PATENT AND TRADEMARK OFFICE

CERTIFICATE OF CORRECTION

PATENT NO. : 5,282,670

DATED : February 1, 1994

INVENTOR(S) : Gary L. Karsten et al.

It is certified that error appears in the above-indentified patent and that said Letters Patent is hereby corrected as shown below:

Column 7, line 62, claim 14;
"and fixed" should be --end fixed--.

Signed and Sealed this

Sixth Day of September, 1994

*Attest:*

*Attesting Officer*

BRUCE LEHMAN

*Commissioner of Patents and Trademarks*